US010429158B2

(12) United States Patent
Lutzenberger

(10) Patent No.: US 10,429,158 B2
(45) Date of Patent: Oct. 1, 2019

(54) FOLDING WING FOR A MISSILE AND A MISSILE HAVING AT LEAST ONE FOLDING WING ARRANGED THEREON

(71) Applicant: MBDA Deutschland GmbH, Schrobenhausen (DE)

(72) Inventor: Jörg Lutzenberger, Augsburg (DE)

(73) Assignee: MBDA DEUTSCHLAND GMBH, Schrobenhausen (DE)

( * ) Notice: Subject to any disclaimer, the term of this patent is extended or adjusted under 35 U.S.C. 154(b) by 243 days.

(21) Appl. No.: 15/344,059

(22) Filed: Nov. 4, 2016

(65) Prior Publication Data

US 2017/0131074 A1 May 11, 2017

(30) Foreign Application Priority Data

Nov. 6, 2015 (DE) ..... 10 2015 014 368

(51) Int. Cl.
*F42B 10/14* (2006.01)
*F42B 10/16* (2006.01)

(52) U.S. Cl.
CPC ..... *F42B 10/14* (2013.01); *F42B 10/16* (2013.01)

(58) Field of Classification Search
CPC ..... F42B 10/16; F42B 10/18; F42B 10/64; F42B 10/14
See application file for complete search history.

(56) References Cited

U.S. PATENT DOCUMENTS 2,858,765 A * 11/1958 Startzell ..... F42B 10/16 244/3.29
2,924,175 A 2/1960 Jasse
3,125,956 A * 3/1964 Kongelbeck ..... F42B 10/16 244/3.29
3,650,496 A 3/1972 Svensson
4,588,145 A * 5/1986 Inglis ..... F42B 10/16 244/3.23
4,588,146 A 5/1986 Schaeffel et al.
5,820,072 A 10/1998 Na et al.
(Continued)

FOREIGN PATENT DOCUMENTS

EP 1 855 076 B1 11/2008
EP 2 083 238 B1 1/2014
(Continued)

OTHER PUBLICATIONS

European Patent Office, European Search Report for European Patent Application No. 16197388.8 dated Mar. 30, 2017.
(Continued)

*Primary Examiner* — Medhat Badawi
*Assistant Examiner* — Christopher D Hutchens
(74) *Attorney, Agent, or Firm* — Lorenz & Kopf LLP

(57) ABSTRACT

A folding wing for a missile comprises a wing root, an upper wing part foldably supported at the wing root around a swiveling axis, at least one first elastically pre-stressed force element and a latching device. The at least one first elastically pre-stressed force element is coupled with the wing root and the upper wing part and is designed for permanently urging the upper wing part into a working position relative to the wing root through introducing a torque. The latching device is designed for arresting the upper wing part on reaching the working position automatically.

4 Claims, 2 Drawing Sheets

(56) References Cited

U.S. PATENT DOCUMENTS

| | | | | |
|---|---|---|---|---|
| 6,739,548 | B1 * | 5/2004 | Bittle | F42B 10/16 244/3.29 |
| 7,552,892 | B1 | 6/2009 | Bittle et al. | |
| 2011/0315812 | A1 * | 12/2011 | Shin | F42B 10/16 244/49 |
| 2012/0048993 | A1 * | 3/2012 | Velez | F42B 10/16 244/3.28 |

FOREIGN PATENT DOCUMENTS

| | | | |
|---|---|---|---|
| FR | 929040 | A | 12/1947 |
| WO | 2009107126 | A1 | 9/2009 |

OTHER PUBLICATIONS

German Patent Office, German Office Action for German Patent Application No. 10 2015 014 368.9 dated Jun. 23, 2016.
European Patent Office, European Search Report for Application No. EP16197396 dated Mar. 27, 2017.

* cited by examiner

FOLDING WING FOR A MISSILE AND A MISSILE HAVING AT LEAST ONE FOLDING WING ARRANGED THEREON

CROSS-REFERENCE TO RELATED APPLICATION

This application claims priority to German Patent Application No. 10 2015 014 368.9, filed Nov. 6, 2015, which is incorporated herein by reference in its entirety.

TECHNICAL FIELD

The embodiment relates to a folding wing for a missile as well as a missile having at least one folding wing arranged thereon.

BACKGROUND

For a space saving storage of missiles in a launching device, it is often designed in a way that an interior space created therein only receives missiles having folded away wings or stabilizer fins. After launch of the missiles, its wings shall unfold or move into a use position, respectively.

In the prior art, a number of different folding wings are known. For example, EP 2 083 238 B1 shows a folding wing having an unfolding device, wherein the folding wing consists of a wing root, an inner wing surface and an outer wing surface, wherein the wing root is connected to a fuselage of the missile through a rotation device. An unfolding of the folding wing is accomplished through a mechanism integrated into the folding wing having pulleys and a pulling cable.

EP 1 855 076 B1 discloses wrapped wings for a missile, which are supported in a region of the outer surface of the missile with their roots and are rotatable around axes that are oriented in flight direction, and reach a working position by means of a drive.

SUMMARY

It is an object of the embodiment to propose a folding wing for a missile, which is mechanically particularly robust, reliable and mechanically simple at the same time, and which is adaptable to different missiles easily.

This object is met by a folding wing for a missile having the features of independent claim 1. Advantageous improvements and embodiments can be derived from the sub-claims and the following description.

A folding wing for a missile is proposed, which comprises a wing root, an upper wing part foldably supported at the wing root around a swiveling axis, at least one first elastically pre-stressed force element and a latching device. The at least one first elastically pre-stressed force element is coupled with the wing root and the upper wing part, and is designed for permanently urging the upper wing part into a working position relative to the wing root through introducing a torque. The latching device is designed for arresting the upper wing part on reaching the working position automatically.

Hence, the folding wing is designed in form of a hinge and may be swiveled from a working position to a fuselage of the missile that carries the folding wing in order to reduce the occupied installation space, wherein the upper wing part automatically moves into a working position, if it is not held through storing the missile.

The wing root of the folding wing is an inner part of the folding wing, which is connected to the fuselage of the missile or constitutes an integral part thereof. The wing root comprises a base having a base contour and/or a resting surface, which connects to the fuselage in a flush manner. The wing root may be a massive or a hollow component, in which optionally reinforcing structures are arranged. Cable ducts may run through the wing root, such that the folding wing may additionally take over the function of cable guiding or covering. In general, different materials may be used, with which a wing root may be manufactured through different manufacturing processes. The manufacturing methods may include machining methods, casting or die casting methods, non-machining forming methods and 3D-printing including SLM methods, as well as precision extrusion.

The foldable upper wing part is to be considered as an outer wing surface and together with the wing root creates a full wing in a folded-out state, i.e. in the working position. The shape of the upper wing part should therefore connect to the shape of the wing root in a flush manner. Through the swiveling function a gap, particularly arranged parallel to the flight direction of the missile or a number of flow-through openings between both wing parts, may occur, which may be minimized or completely eliminated through dimensioning the required swiveling mechanism.

A special feature of the folding wing according to the embodiment lies in the mechanically very simple, yet reliable and low-weight design of a folding mechanism. The elastically pre-stressed force element is preferably arranged particularly near at or in the swiveling axis and may at least partially be integrated into the upper wing part or the wing root. Through the pre-stress, a permanent torque acts onto the upper wing part, which is urged to a rotation around the swiveling axis. The force element further preferably comprises a neutral point, which leads to a swiveling only up to a working position. As an alternative or additionally thereto, the upper wing part and/or the wing root may be adapted for providing a stop for limiting a swiveling motion.

If the missile is stored in a space-saving manner and with a folded-away upper wing part, the upper wing part automatically swivels into the working position after the start of the missile and will be latched therein, wherein the latching device integrated for this purpose may be created in different ways. Since the folding wing should be mechanically as simple as possible, form-fit and self-latching connections are to be preferred.

The latching may be realized by catches that are supported in a spring-loaded manner and corresponding arresting recesses or through an axial row of shape features corresponding to each other, which allow an axial shift and a resulting form-fit of the upper wing part. Many different variants can be considered for the embodiment, which should not be construed as limiting.

Besides the robustness and reliability, the folding wing is characterized by the ability of scaling and simple adaption to other missiles, as the wings do not interfere with the hull of the missile. The wing root may be manufactured integrally with the missile section or may be attached to the missile section on an exterior side, wherein in the latter case the wide wing root provides an additional installation space, which may be used as a cable duct.

In an advantageous embodiment, the upper wing part comprises a first hinge component having at least one first hinge bushing and the wing root comprises a second hinge component having at least one second hinge bushing. The first and second hinge bushings are adapted for gliding along each other at least outside of the working position. Furthermore, an axle element extends through axle openings of the first and second hinge bushing. The design of the folding wing as a hinge having an axle element, which engages with two hinge components and determines the swiveling axis is simple, robust and reliable, and furthermore allows the integration of one or a plurality of elastically pre-stressed force elements, particularly through a support at the axle element. The hinge may comprise a plurality of first and second hinge bushings. A hinge bushing is furthermore to be understood as an element having a ring shape or a hollow cylindrical shape.

The latching device may furthermore comprise form-fit means that are corresponding with each other, which are arranged at the first and second hinge bushing, wherein the form-fit means engage each other upon reaching the working position. Through integration of the latching device into the hinge, the design of the folding wing may even further be simplified and particularly compacted. Should a plurality of first and second hinge bushings are to be utilized, also a plurality of hinge bushings may be equipped with such a latching device. It may be feasible to equip exemplarily two first hinge bushings and two second hinge bushings with a latching device, such that a reliable latching of an upper wing part in the working position may be achieved also at adverse environmental conditions. Resultantly, the redundancy of the latching device may be increased for larger hinges.

In a further advantageous embodiment, the latching device comprises a second, pre-stressed force element, which presses the first and second hinge bushing onto each other in an axial direction. The first hinge component is movably supported along the swiveling axis and is moved from an axial swiveling position into an axial latching position through the second force element upon engagement of the form-fit means. Hence, separate movable arresting means are expendable. Under action of the second pre-stressed force element, a force acts at least onto the first hinge component having a distinct direction component along the swiveling axis. The rotation of the hinge is substantially not hindered, but, depending on the realized form-fit means, leads to an arresting of the form-fit means in a working position and, due to the permanent pressure through the second pre-stressed force element, is also held in the arrested position. The form-fit means may be of different nature, which are designed such that only by reaching the working position an alignment and, consequently, an arresting is accomplished.

It is advantageous, if the first hinge bushing comprises a first form-fit means at a distance from the swiveling axis and facing the wing root, which first form-fit means is shaped corresponding to a second form-fit means at the second hinge bushing. The first and second form-fit means are thereby preferably arranged relative to each other in such a manner that the first form-fit means only directly before and in the working position engages the second form-fit means.

The first form-fit means may be a first protrusion and the second form-fit means may be a delimiting edge of the second hinge bushing. The first protrusion may align with the delimiting edge upon reaching the working position and may be shifted through the pressure exerted by the second force element along the delimiting edge. Afterwards, the first protrusion and an area connecting to the delimiting edge preferably align with each other, such that only by pushing the first hinge component along the hinge axis back, a swiveling back of the upper wing component to the fuselage of the missile is possible.

The second pre-stressed force element may at least comprise an elastic tensioning element, which may substantially be a tension spring, a tension belt or a combination thereof. As an alternative, a pressing spring may be utilized, which exerts a pressure onto the respective hinge component instead of a pulling force.

It is to be understood, that the hinge must allow a certain movability along the hinge line, i.e. in an axial direction. The first and second hinge component may resultantly comprise a respective gliding tolerance, which allows a movement of both hinge components relative to each other without canting. In this regard, it is feasible to provide a certain width at the contact surface with a hinge axis, which reduces the danger of canting. This width depends on the general dimensioning of the hinge bushings as well as the extension of the hinge components itself, wherein the required width may also be reduced by arranging a plurality of hinge bushings at a distance to each other.

The first force element may exemplarily be a leg spring or a rotational spring, respectively, which is particularly easily to integrate to the axle element and loadable in the direction of winding. A leg spring may comprise a free-cross-section around a rotational spring axis. The leg spring could be laid around the axle element with its free-cross-section, which additionally secures the spring from jumping out. Additionally, such a fastening defines the direction of the torque to be introduced.

The embodiment furthermore relates to a missile having a fuselage and at least one folding wing attached thereon and described above.

BRIEF DESCRIPTION OF THE DRAWINGS

Further characteristics, advantages and potential applications of the present embodiment result from the following description of the exemplary embodiments and the figures. In this respect, all described and/or graphically illustrated characteristics also form the object of the embodiment individually and in arbitrary combination regardless of their composition in the individual claims or their references to other claims. Furthermore, identical or similar objects are identified by the same reference symbols in the figures.

DETAILED DESCRIPTION

Figure 1:
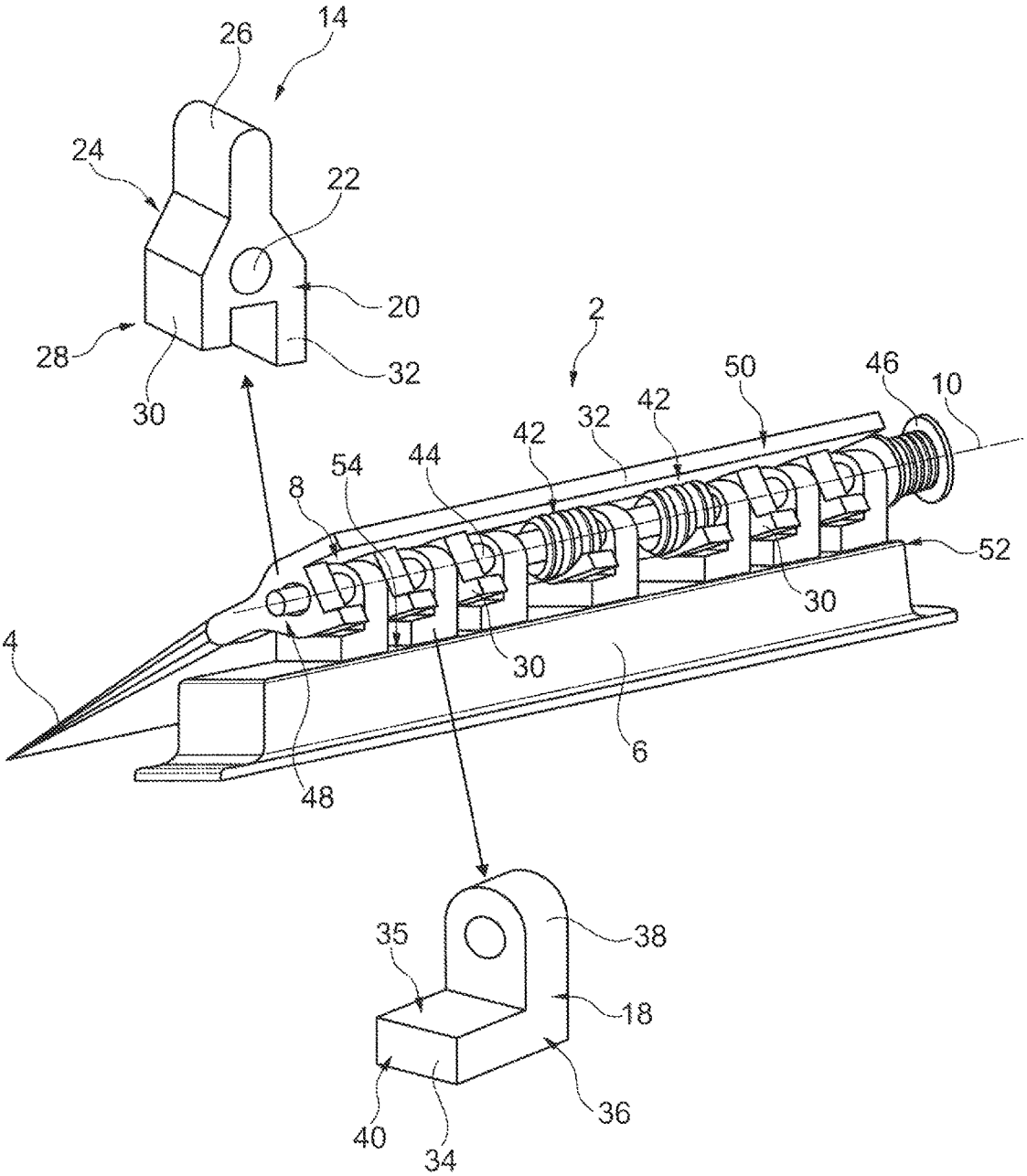
FIG. 1 shows an exemplary embodiment of a folding wing in an isometric view having a folded-away upper wing part.

FIG. 1 shows a folding wing 2 having an upper wing part 4 and a wing root 6, wherein the upper wing part 4 is arranged in a swiveling manner at the wing root 6 through a hinge 8 creating a hinge axis 10. The hinge 8 comprises a first hinge component 12 integrated into the upper wing part having a number of first hinge bushings 14 as well as a second hinge component 16 integrated into the wing root having a number of second hinge bushings 18. For integration, the hinge components 12 and 16 may be realized as single parts with the upper wing part 4 or the wing root 16, respectively, or may be attached thereto.

For clarification of an exemplary design, a first hinge bushing 14 and a second hinge bushing 18 are illustrated separately. The first hinge bushing 14 comprises a base 20, in which an axle borehole 22 is arranged. From a first side 24 of the base 20, a flange 26 extends for receiving the upper wing part 4, wherein this is slightly tapered relative to the base and arranged symmetrically thereto. At a second side 28 opposite the first side 24 a first protrusion 30 as well as a second protrusion 32 are arranged at one outer edge of the base each, wherein the second protrusion 32 clearly further extends away from the base 20 in comparison to the first protrusion 30. As is apparent in the overview of the whole folding wing 2, all second protrusions 32 of all first hinge bushings 14 create a surface-like stop. In the context of the above description, both protrusions 30 and 32 are to be considered as first form-fit means.

A second hinge bushing 18 comprises a surface-like base 34 having an upper resting surface 35, wherein at an outer edge 36 a surface-like flange 38 having an axle borehole 40 is arranged eccentrically to the surface of the base 34 and extends therefrom substantially perpendicular thereto. The base 34 is connected to the wing root 6 through a surface opposite the resting surface 35 in planar fashion. The resting surface 35 is to be understood as a second form-fit means, which corresponds with the first form-fit means in form of the first protrusion 30.

In the position, shown in FIG. 1, the hinge bushings 14 and 18 touch each other with gliding surfaces facing to each other, such that the first hinge bushing 14 touches an end surface 40 of a base 34 of a neighboring second hinge bushing 18.

Two rotational springs 42, which are to be considered as "first pre-stressed force element" in context with the above description, are arranged between the upper wing part 4 and the wing root 6, are mechanically coupled with these and permanently exert a torque onto the upper wing part 4, such that it is urged into a working position, in which the upper wing part 4 is arranged perpendicular to the wing root 6, and creates a full, usable wing with it. An axle element 44 extends through all axle boreholes 22 and 40 of the hinge components 12 and 16.

A second pre-stressed force element in form of a spring 40, which is connected to the axle element 44, which is furthermore mechanically coupled with the first hinge bushing 14 through a locking ring 48, urges the hinge bushing 14 to the neighboring second hinge bushing 18 along the hinge axis 10. Upon reaching the working position, this lead to an axial placement of the upper wing part 4 relative to the wing root 6, as shown in FIG. 2 in the following.

Figure 2:
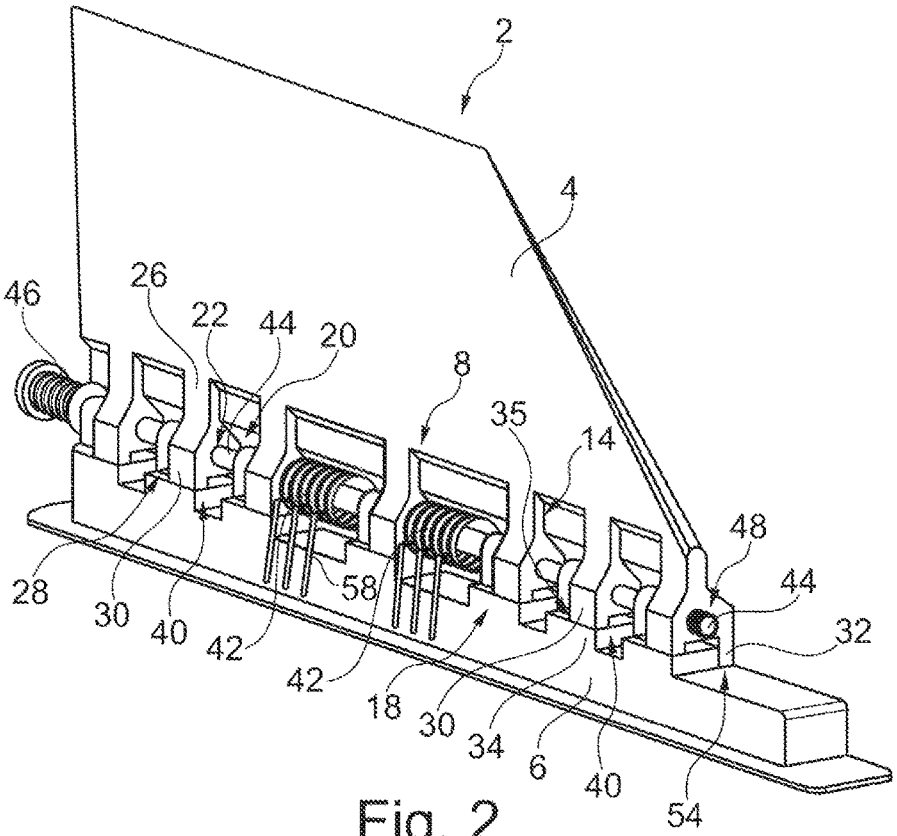
FIG. 2 shows the folding wing in an isometric view with the upper wing part in a working position.

FIG. 2 shows the folding wing 2 in the working position, in which the upper wing part 4 having the first hinge component 12 is displaced relative to the second hinge component 16 along the hinge line 10 compared to the illustration in FIG. 1. This is made possible by the first protrusion 30 of the first hinge bushing 14 being rotated so far around the hinge axis 10 through a torque acting upon the upper wing part 4 that they just do not touch the end surface 40 of the second hinge bushings 18. In result, the force permanently introduced by the spring 46 during the rotation process leads to shifting the first hinge bushings 14 along each base 34 of the second hinge bushings 18 along the hinge axis 10, until the first hinge bushings 14 snuggly touch the flanges 38. The first protrusions 30 then rest on the respective associated bases 34, preventing a swiveling-back of the upper wing part 4. Hence, the combination of a first protrusion 30, a base 34, and a spring 46 create a latching device, which reliably and mechanically simple conducts a latching of the upper wing part in the working position.

The continuous connection of a plurality of second protrusions 32 leads to the creation of an elongate web, which flushly rests on the wing root 6 with an end surface 50 in the working position. As apparent from FIG. 1, each base 34 extends to an outer edge 52 of the wing root 6 not to a full extent, but in each case leaves free a resting surface 54, respectively. In the context of the above description, the resting surface is to be understood as a second form-fit means, which corresponds to the first form-fit means in form of the second protrusion 32. As shown in FIG. 2, the second protrusions 32 snuggly rest on the resting surface 54 and consequently cover the hinge 8 to prevent a through-flow. Additionally, a swiveling of the upper wing part 4 over the working position is prevented.

Figure 3A:
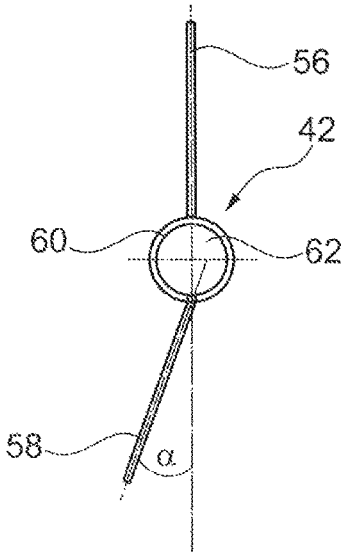
FIGS. 3*a* and 3*b* show an exemplary embodiment of a first, pre-stressed force element in two different illustrations.
Figure 3B:
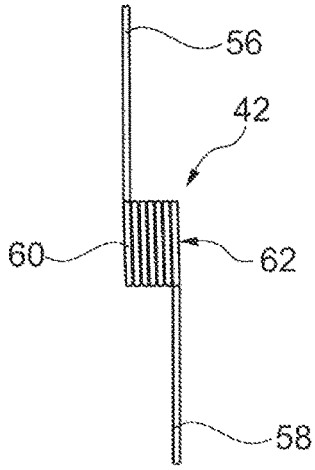

For a further clarification, FIGS. 3*a* and 3*b* show an exemplary design of the rotational spring 42, which is also known as "leg spring", in different views. The rotational spring 42 comprises two legs 56 and 58, which at both sides connect to a winding arrangement 60, which creates the torque. The winding arrangement 60 comprises a through-opening 62, through which a positioning at the axle element 44 may be accomplished. The legs 56 and 58 each are mechanically connected to the upper wing part 4 or the wing root 6, respectively, e.g. through insertion into a suitable bore hole in the upper wing part and the form-fit pressing to the wing root 6, as apparent from e. g. FIG. 2.

In addition, it should be pointed out that "comprising" does not exclude other elements or steps, and "a" or "an" does not exclude a plural number. Furthermore, it should be pointed out that characteristics or steps which have been described with reference to one of the above exemplary embodiments may also be used in combination with other characteristics or steps of other exemplary embodiments described above. Reference characters in the claims are not to be interpreted as limitations.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the embodiment in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the embodiment as set forth in the appended claims and their legal equivalents.

What is claimed is:

1. A folding wing for a missile, comprising:

a wing root connected to or integrated with a fuselage of the missile, the wing root comprising a resting surface;

an upper wing part foldably supported at the wing root around a swiveling axis of a hinge, the hinge comprising a first hinge bushing integrated into the upper wing part, a second hinge bushing integrated into the wing root, and an axle element;

the first hinge bushing comprising:

a gliding side surface;

a first base having a first axle borehole to receive the axle element, a first side from which the upper wing part extends, and a second side opposite the first side;

a first protrusion extending from the second side of the first base; and a second protrusion extending from the second side of the first base, wherein the second protrusion extends further away from the first base in comparison to the first protrusion;

the second hinge bushing comprising:

a second base having an upper resting surface and a side end surface;

a flange extending from the upper resting surface of the second base; and a second axle borehole arranged in the flange to receive the axle element;

a first pre-stressed force element coupled with the wing root and the upper wing part to urge the upper wing part into a working unfolded position relative to the wing root through introducing a torque; and a second pre-stressed force element configured to axially urge the first hinge bushing and the second hinge bushing onto each other in an axial direction of the hinge;

wherein, when the folding wing is in a folded state, the gliding side surface of the first hinge bushing touches the side end surface of the second hinge bushing, and the first hinge bushing does not touch the flange of the second hinge bushing; and wherein, when the folding wing is in the working unfolded position, the first hinge bushing touches the flange of the second hinge bushing, an end surface of the first protrusion of the first hinge bushing rests on the upper resting surface of the second hinge bushing to prevent swiveling back of the upper wing part, and an end surface of the second protrusion of the first hinge bushing rests on the resting surface of the wing root to prevent over-swiveling of the upper wing part beyond the working unfolded position.

2. The folding wing of claim 1, wherein the second pre-stressed force element comprises at least one elastic tensioning element.

3. The folding wing of claim 1, wherein the first force element is a leg spring.

4. A missile comprising a fuselage and the folding wing of claim 1 attached to the fuselage.

* * * * *